US009168542B2

(12) United States Patent
Lin

(10) Patent No.: US 9,168,542 B2
(45) Date of Patent: Oct. 27, 2015

(54) WATER-EJECTION-ANGLE ADJUSTABLE SHOWER HEAD

(71) Applicant: Xiamen Runner Industrial Corporation, Xiamen (CN)

(72) Inventor: Chun-Hui Lin, Xiamen (CN)

(73) Assignee: XIAMEN RUNNER INDUSTRIAL CORPORATION, Xiamen (CN)

( * ) Notice: Subject to any disclaimer, the term of this patent is extended or adjusted under 35 U.S.C. 154(b) by 0 days.

(21) Appl. No.: 14/494,953

(22) Filed: Sep. 24, 2014

(65) Prior Publication Data

US 2015/0115067 A1 Apr. 30, 2015

(30) Foreign Application Priority Data

Oct. 31, 2013 (CN) ..... 2013 2 0679401 U

(51) Int. Cl.
*B05B 1/18* (2006.01)
*B05B 15/08* (2006.01)
*B05B 1/16* (2006.01)

(52) U.S. Cl.
CPC ..... *B05B 1/18* (2013.01); *B05B 1/1654* (2013.01); *B05B 15/08* (2013.01)

(58) Field of Classification Search
CPC ..... B05B 1/18; B05B 1/185; B05B 15/066; B05B 15/067; B05B 15/08
See application file for complete search history.

(56) References Cited

U.S. PATENT DOCUMENTS

| | | | | |
|---|---|---|---|---|
| 8,016,215 | B1 * | 9/2011 | Zhadanov et al. | 239/544 |
| 2008/0223957 | A1 * | 9/2008 | Schorn | 239/428.5 |
| 2011/0210189 | A1 * | 9/2011 | Chen | 239/214 |
| 2014/0077005 | A1 * | 3/2014 | Chen | 239/548 |

* cited by examiner

*Primary Examiner* — Darren W Gorman
(74) *Attorney, Agent, or Firm* — Chun-Ming Shih

(57) ABSTRACT

A water-ejection-angle adjustable shower head includes a main body, and a swing rod, a water dispenser disk, an upper plate, and a lower plate built in the main body from top to bottom. An upper end of the lower plate passes through the upper plate and is hinged onto the water dispenser disk. A center of the swing rod is hinged onto a center of the water dispenser disk. The water-ejection-angle adjustable shower head can be operate to make the water outage holes on a lower surface of the lower plate to swing to various different directions, to form the dispersion water ejections or converging and merging water ejections. As such, the form and intensity of water ejections can be varied, to meet the demands of various customers.

5 Claims, 5 Drawing Sheets

WATER-EJECTION-ANGLE ADJUSTABLE SHOWER HEAD

BACKGROUND OF THE INVENTION

1. Field of the Invention

The present invention relates to shower head, and in particular to water-ejection-angle adjustable shower head.

2. The Prior Arts

Shower head is a kind of water ejection device utilized in a shower, and it can be classified into three categories: (1) portable shower head, that can be held in a user's hand to more freely around, and a shower head support is used to fix the shower head when it is not in use; (2) overhead shower head, that is put and fixed in an overhead position, with its support built in the wall, thus it can not move up and down; and (3) side position shower head, that is put into the wall sideways to the body, such that it may have a plurality of installation positions and water ejection angles, to provide cleaning and massage functions.

Though the shower head is capable of providing a plurality of water ejection functions and types, yet presently, an adjustable shower head is not available, that is capable of providing dispersion water ejections, or water ejections converging and merging with one another, to change the form and intensity of the water ejections to meet the demands of various customers.

Therefore, presently, the design and performance of the shower head is not quite satisfactory, and it has much room for improvement.

SUMMARY OF THE INVENTION

In view of the problems and drawbacks of the prior art, the present invention provides a water-ejection-angle adjustable shower head, that is simple in construction and optimized in design, and that is apt to realize the dispersion water ejections or converging and merging water ejections, to meet the demands of various customers.

The water-ejection-angle adjustable shower head can be realized in the following embodiment.

The water-ejection-angle adjustable shower head of the present invention is characterized in that, the shower head includes a main body, and a swing rod, a water dispenser disk, an upper plate, and a lower plate built in the main body from top to bottom, The upper end of the lower plate passes through the upper plate and is hinged onto the water dispenser disk. The center of the swing rod is hinged onto the center of the water dispenser disk. The side of the swing rod is provided with groove for the upper end of the lower plate to insert in, to facilitate the swing rod to swing and to bring the lower plate to swing. On the lower surface of the lower plate is provided with the water outage hole in communication with the water inlet hole on the upper end of the main body of the shower head.

On the water dispenser disk is hinged with two lower plates. The lower plate includes a lower plate cover and a lower plate hood. A protrusion rod is provided on the upper end of lower plate cover. On the side of the lower plate cover is provided with a hinge rotation axis. In the rotation axis is provided with water passage holes in communication with the water outage holes on the lower surface of the lower plate hood.

The main body includes an upper hood and a water outage plate. On the water outage plate is provided with two round holes for placing the lower plate. The water outage plate is provided with water outage holes around the perimeter of the round hole, so that the upper hood is penetrated with a swing head for pushing the swing rod.

On the water dispenser disk is provided with two holes penetrating though the lower plate. On the surface of the water dispenser disk is further provided with a protrusion column restricting the swing of the swing rod. An arc face is provided on the protrusion column corresponding to the outer rim arc face of the swing rod.

The hinge rotation axis on the side of the lower plate cover is hinged onto the upper plate.

The operation principle of the water-ejection-angle adjustable shower head is that, through the swing of the swing rod, the upper end of the lower plate is swung along the groove, so that the water outage holes on the lower surface of the lower plate can be swung to various different directions, to form the dispersion water ejections or converging and merging water ejections As such, the form and intensity of water ejections can be varied, to meet the demands of various customers.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from this detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed description with reference to the attached drawings.

Figure 1:
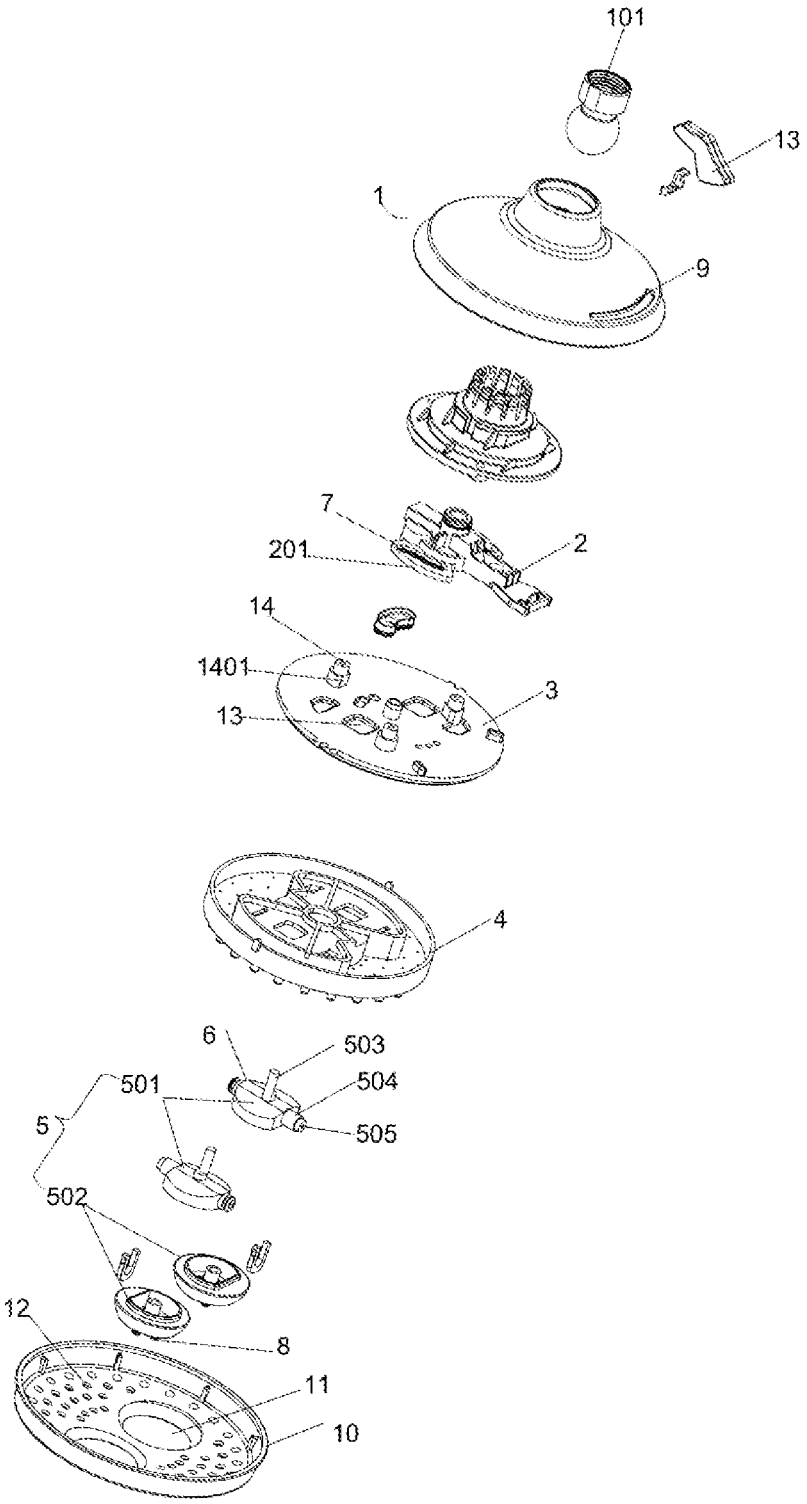
FIG. 1 is an exploded view of a water-ejection-angle adjustable shower head according to the present invention.
Figure 2:
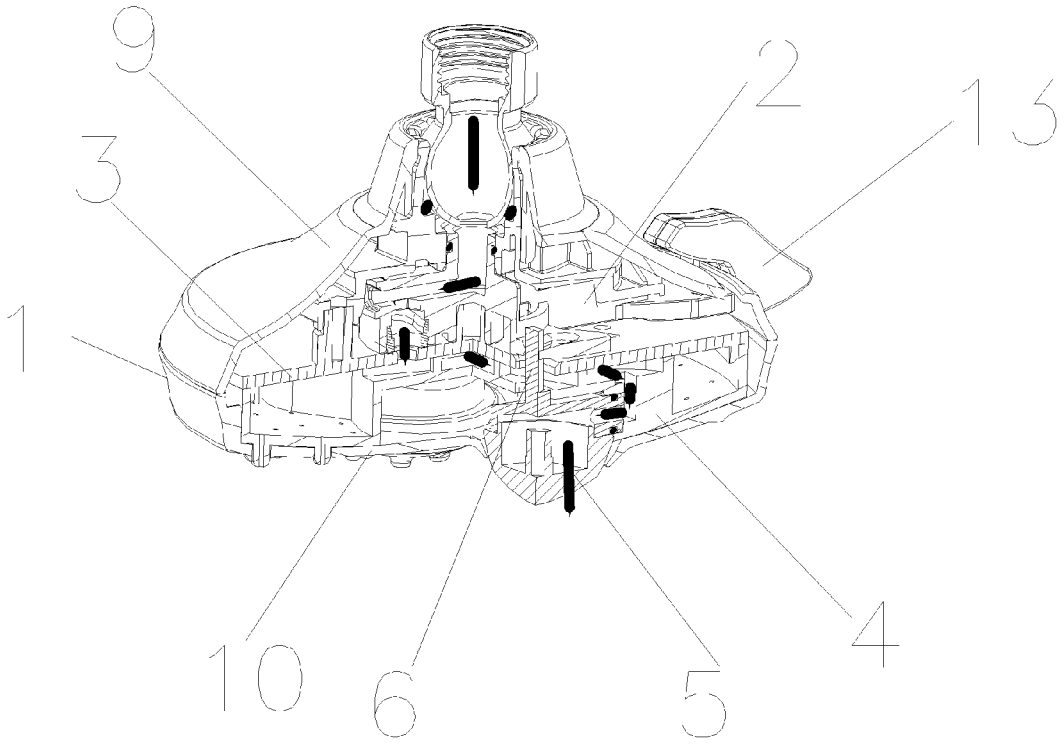
FIG. 2 is a cross section view of a water-ejection-angle adjustable shower head according to the present invention.
Figure 3:
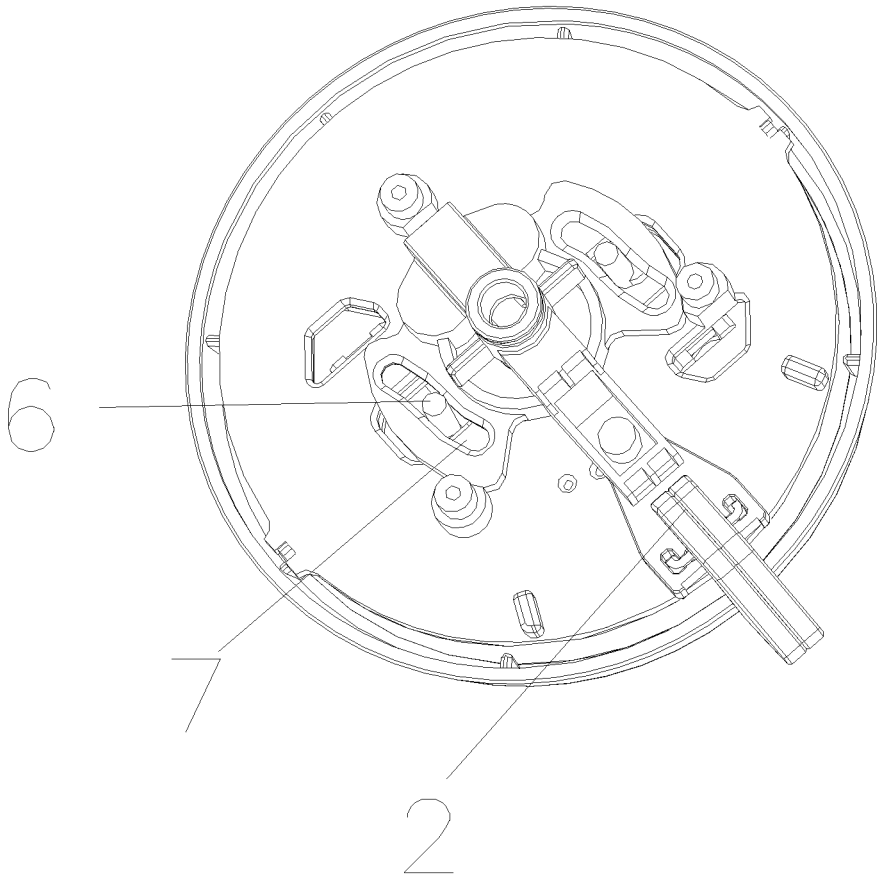
FIG. 3 is a top view of a water-ejection-angle adjustable shower head with its upper hood removed according to the present invention.
Figure 4:
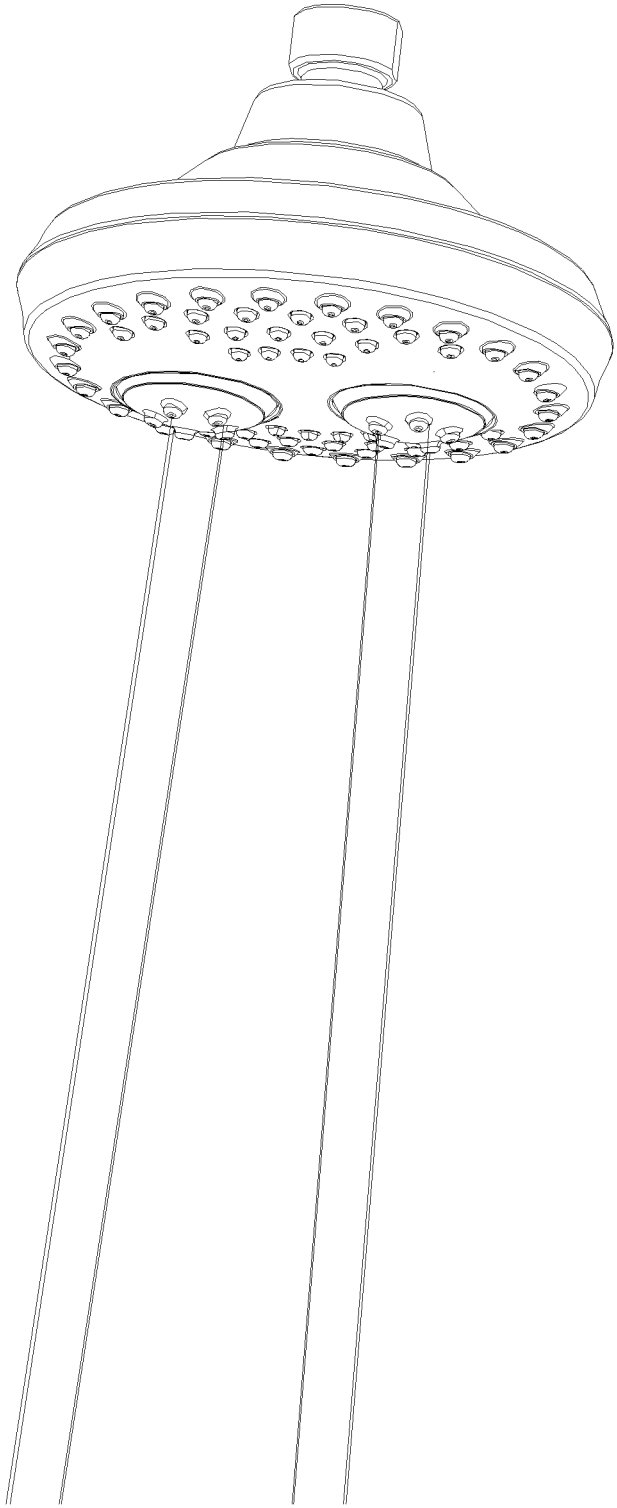
FIG. 4 is a schematic diagram showing water-ejection-angle adjustable shower head in water ejection operation according to the present invention.
Figure 5:
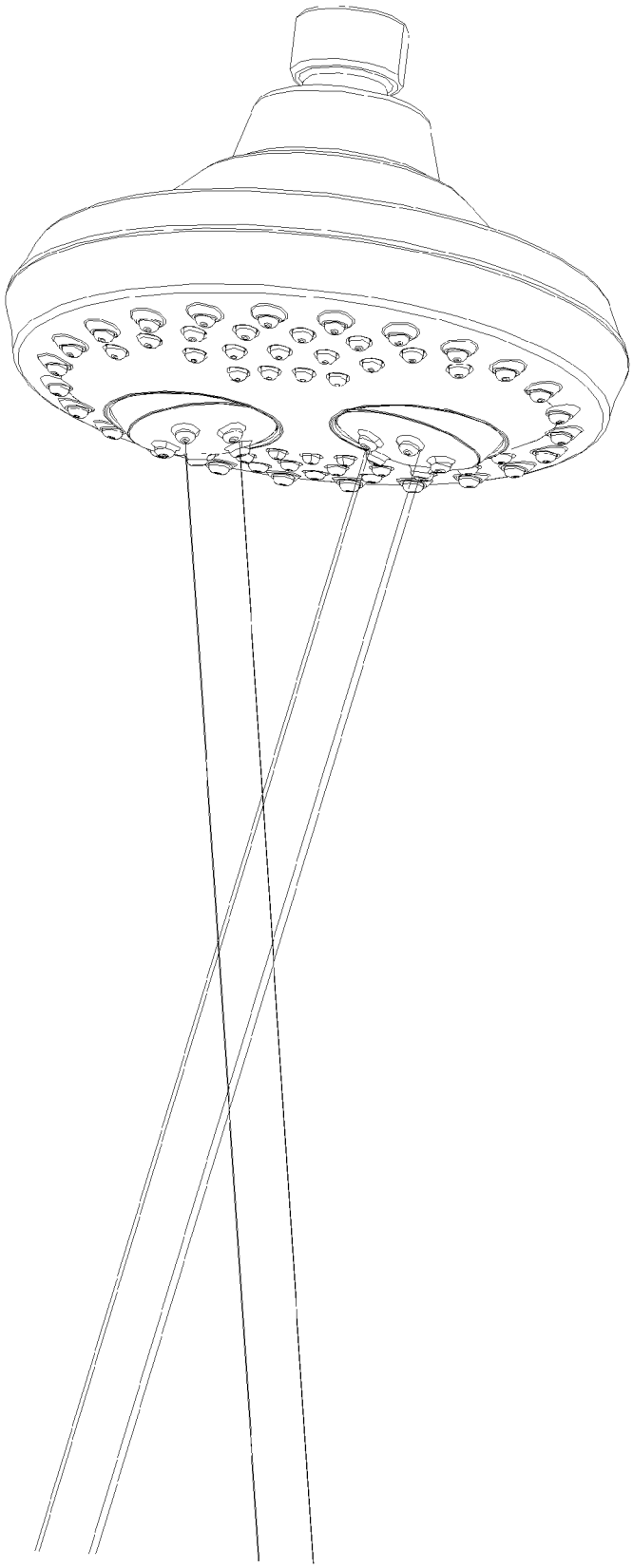
FIG. 5 is a schematic diagram showing water-ejection-angle adjustable shower head in another water ejection operation according to the present invention.

Refer to FIGS. 1 to 5 respectively for an exploded view of a water-ejection-angle adjustable shower head according to the present invention, a cross section view of a water-ejection-angle adjustable shower head according to the present invention, a top view of a water-ejection-angle adjustable shower head with its upper hood removed according to the present invention, a schematic diagram showing water-ejection-angle adjustable shower head in water ejection operation according to the present invention, and a schematic diagram showing water-ejection-angle adjustable shower head in another water ejection operation according to the present invention. As shown in FIGS. 1 to 5, the water-ejection-angle adjustable shower head includes a main body 1, and a swing rod 2, a water dispenser disk 3, an upper plate 4, and a lower plate 5 built in said main body 1 from top to bottom, The upper end of the lower plate 5 passes through the upper plate 4 and is hinged onto the water dispenser disk 3. The center of the swing rod 2 is hinged onto the center of the water dispenser disk 3. The side of the swing rod 2 is provided with groove 7 for the upper end 6 of the lower plate 5 to insert in, to facilitate the swing rod 2 to swing and to bring the lower plate 5 to swing. On the lower surface of the lower plate 5 is provided with the water outage hole 8 in communication with the water inlet hole 101 on the upper end of the main body 1 of the shower head.

To achieve optimized design, two lower plates 5 are hinged on the water dispenser disk 3. The lower plate 5 includes a lower plate cover 501 and a lower plate hood 502. A protrusion rod 503 is provided on the upper end of lower plate cover 501. On the side of the lower plate cover 501 is provided with a hinge rotation axis 504. In the rotation axis 504 is provided with water passage holes 505 in communication with the water outage holes 8 on the lower surface of the lower plate hood 502.

To facilitate support, the main body 1 includes an upper hood 9 and a water outage plate 10. On the water outage plate 10 is provided with two round holes 11 for placing the lower plate 5. The water outage plate 10 is provided with water outage hole 12 around the perimeter of the round hole 11, so that the upper hood 9 is penetrated with a swing head 13 for pushing the swing rod 2.

To stabilize components positioning, two holes 13 are provided on the water dispenser disk 3 for penetrating though the lower plate 5. On the surface of the water dispenser disk 3 is further provided with a protrusion column 14 restricting the swing of the swing rod 2. An arc face 1401 is provided on the protrusion column 14 corresponding to the outer rim arc face 201 of the swing rod 2.

Also, to achieve optimized design, the hinge rotation axis on the side of the lower plate cover 501 is hinged onto the upper plate 4.

The operation principle of the water-ejection-angle adjustable shower head is that, through the swing of the swing rod, the upper end of the lower plate is swung along the groove, so that the water outage holes on the lower surface of the lower plate can be swung to various different directions, to form the dispersion water ejections or converging and merging water ejections. As such, the form and intensity of water ejections can be varied, to meet the demands of various customers.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A water-ejection-angle adjustable shower head, comprising a main body, a swing rod, a water dispenser disk, an upper plate, and a lower plate built in said main body from top to bottom, wherein an upper end of said lower plate passes through said upper plate and is hinged onto said water dispenser disk, a center of said swing rod is hinged onto a center of said water dispenser disk, a side of said swing rod is provided with a groove for said upper end of said lower plate to insert in, to facilitate said swing rod to swing and to bring said lower plate to swing, on a lower surface of said lower plate is provided with a first water outage hole in communication with a water inlet hole on an upper end of said main body of said shower head.

2. The water-ejection-angle adjustable shower head as claimed in claim 1, wherein there are two lower plates; on the water dispenser disk is hinged with said two lower plates, each lower plate includes a lower plate cover and a lower plate hood, a protrusion rod is provided on said upper end of said lower plate cover, on a side of said lower plate cover is provided with a hinge rotation shaft, and in said rotation shaft is provided with an water passage hole in communication with said first water outage hole.

3. The water-ejection-angle adjustable shower head as claimed in claim 2, wherein said main body includes an upper hood and a water outage plate, on said water outage plate is provided with two round holes for placing said two lower plates, respectively, said water outage plate is provided with a plurality of second water outage holes around perimeter of said two round holes, and said upper hood is penetrated with a swing head for pushing said swing rod.

4. The water-ejection-angle adjustable shower head as claimed in claim 2, wherein on said water dispenser disk is provided with two holes for said two lower plates penetrating though, respectively, on a surface of said water dispenser disk is further provided with a protrusion column restricting swing of said swing rod, an arc face is provided on said protrusion column corresponding to an outer rim arc face of said swing rod.

5. The water-ejection-angle adjustable shower head as claimed in claim 2, wherein said hinge rotation shaft is hinged onto said upper plate.

* * * * *